United States Patent [19]

Denoyer et al.

[11] 4,426,597

[45] Jan. 17, 1984

[54] IONIZED GAS GENERATOR AT VERY HIGH TEMPERATURE AND VERY HIGH PRESSURE

[75] Inventors: Serge Denoyer, Andresy; Jacques Guerin, Pessac; Maxime Labrot, Bordeaux; Jean-Pierre Serrano, Saint-Aubin-de-Medoc, all of France

[73] Assignee: Commissariat a l'Energie Atomique, Paris, France

[21] Appl. No.: 221,498

[22] Filed: Dec. 30, 1980

[30] Foreign Application Priority Data

Jan. 7, 1980 [FR] France ..... 80 00231

[51] Int. Cl.[3] ..... H01J 17/26; H01J 7/24

[52] U.S. Cl. ..... 313/231.41; 313/231.51; 315/111.11; 315/111.81

[58] Field of Search ..... 313/231.41, 231.51; 315/111.1, 111.8

[56] References Cited

U.S. PATENT DOCUMENTS

| | | | |
|---|---|---|---|
| 2,972,696 | 2/1961 | Kantrowitz et al. | 313/231.41 |
| 3,400,070 | 9/1968 | Naff | 313/231.51 |
| 3,521,106 | 7/1970 | Hess | 313/231.51 |
| 3,891,562 | 6/1975 | Mogensen et al. | 313/231.51 |

*Primary Examiner*—Harold Dixon

*Attorney, Agent, or Firm*—Kerkam, Stowell, Kondracki & Clarke

[57] ABSTRACT

The present invention relates to an ionized gas generator with supersonic homogeneous flow. This generator comprises unitary modules comprising:

- two coaxial electrodes of cylindrical form, the downstream electrode being open and having the flow passing therethrough;
- means for injecting as vortical gas along planes perpendicular to the axis common to said electrodes, the gas thus injected passing through an electric arc which consequently takes an elongated form;
- means for striking the arc between the two coaxial electrodes;
- means for cooling the electrodes, the gas injection devices and the coupling chamber;
- coils creating around the first upstream electrode a magnetic field ensuring the displacement of the base of the arc around the inner surface of said upstream electrode.

The invention is applicable to testing of heat-protection materials.

3 Claims, 3 Drawing Figures

IONIZED GAS GENERATOR AT VERY HIGH TEMPERATURE AND VERY HIGH PRESSURE

The present invention relates to the production of ionized gas at very high temperature and very high pressure, by heating by means of high power D.C. electric arcs. It is known, particularly in spatial techniques, to use such ionized gas generators for testing and choosing materials for the thermal protection of space vehicles whose trajectories include in particular a phase of rapid re-entry into the atmosphere, during which the external parts constituting the vehicle are taken very rapidly to temperatures of several thousands of degrees.

Generators are already known which heat air or other gases with one or more high power D.C. electric arcs. These generators belong to two main families whose major principles will be recalled herein:

the first family of ionized gas generators comprises, between two coaxial tubular electrodes generally made of copper or a copper alloy, connected by an air injection chamber, a D.C. electric arc which extends under the effect of an injection of vortical air. The hot air at very high temperatures and very high pressure is expanded through a nozzle coaxial to the electrodes so as to produce a flow at very high temperature and at high speed. Auxiliary devices allow striking of the arc, generally by a starter electrode, and the rotation of the arc bases avoiding the fusion of the electrodes, by magnetic field coils.

the second family of generators concerns generators constituted by a plurality of unitary modules connected by a coupling chamber equipped with a nozzle for emission of the ionized gas. Each module is, per se, a generator constituted by a sphero-cylindrical electrode made of graphite and a coaxial tubular electrode made of copper or copper alloy, connected by a vortical air injection chamber. An electric arc strikes between the electrodes of each module. The air heated at each module passes in the coupling chamber then is expanded through the nozzle of which the axis is perpendicular to the plane constituted by the modules, so as to produce a flow at very high temperature and at high speed. Auxiliary devices allow striking of the arcs, generally by fuse wires, and the rotation of the arc bases on the copper or copper-alloy electrodes by magnetic field coils.

The two families of generators are used for testing test pieces, as follows:

The test pieces of material, introduced or previously positioned in the flow, are subjected to aerothermic conditions similar to those to which the same material equipping the space vehicle will be subjected during the phase of atmospheric re-entry. The test pieces of material introduced in the axis of the jet are generally sphero-conical or sphero-cylindrical in form (so-called "stagnation point" tests). The test pieces of material previously positioned parallel to the axis of the jet are in parallelepipedic form (so-called "square tube" tests).

The performances obtained on a test piece of material are a function of its shape and its position in the jet. With equal performances of the generator, the test pieces in the axis of the jet are generally subjected to aerothermic conditions more severe than those parallel to the axis of the jet, but with results of measurement more difficult to exploit.

The performances of the first family of generators, developed essentially by the American firm "Union Carbide Corporation" and of which multiple specimens exist in a range of electric powers ranging from a few hundreds of kilowatts to a few tens of megawatts, are rathermore oriented towards obtaining jets of ionized gas of very high pressures and relatively moderate enthalpies, these conditions being measured upstream of the neck of the nozzle.

The performances of the second family of generators, essentially developed by the American firm "AVCO Corporation" and of which a few specimens with a power of the order of about ten megawatts exist, are rathermore oriented towards obtaining jets of moderate pressures and very high enthalpies, these conditions also being measured upstream of the neck of the nozzle. Reference will usefully be made on this subject to the communication made by Dicristina, Hoercher and Siegelman at the "Intersociety Conference on Environmental Systems" at San Diego, Calif. from July 12 to 15, 1976.

However, these generators present certain drawbacks associated with their performances and possibilities of use in testing test pieces of material.

Although the generators of the first family have performances well adapted to carrying out so-called "stagnation point" tests due to their functioning at high pressure, a drawback in exploiting these tests results from the very inhomogeneous temperatures distribution in the nozzle outlet jet, resulting from the injection of vortical air, the test pieces are subjected to considerably evolutive aerothermic conditions, thus rendering the exploitation of these tests more difficult. Another drawback is the misappreciation of the direct thermal radiation coming from the arc which heats the test piece of material and which is consequently added to the convective heating of this same material by the actual flow of ionized gas.

Concerning the so-called "square tube" tests, the major drawback for their exploitation results from the very inhomogeneous distribution of the temperature in the jet, with, in addition, vortical mechanical effects produced by the injection of air.

The major drawback of the generators of the second family is low performances in kinetic pressure, preventing a whole range of tests with test pieces placed in configuration of the "stagnation point" type.

It is precisely an object of the present invention to provide an ionized gas generator for studying test pieces at very high temperature and very high pressure, which combines the advantages particular to each of the two preceding families of generators, allowing the production of ionized gas at very high kinetic pressures and moderate enthalpies with a homogeneous flow of ionized gas and without direct radiation of the arc on the test piece of material to be tested.

This ionized gas generator, of the type such as those which comprise a certain number of generators or unitary modules associated with a coupling chamber equipped with a nozzle, is characterised mainly in that each of the unitary modules comprises:

two coaxial electrodes supplied with high voltage of at least several thousands of volts, made of copper or copper alloy, substantially cylindrical and hollow in form, located one behind the other, one upstream and the other downstream with respect to the direction of flow of the ionized gas, the downstream electrode being open and having this flow passing therethrough;

means for injecting a gas, for example air, in vortices along planes perpendicular to the axis common to said electrodes, in the intermediate zone between the first upstream electrode and the second downstream electrode, the gas thus injected passing through an electric arc which consequently takes an elongated form able to extend from the end of the upstream electrode up to the end of the downstream electrode, which is open at its end and opens in one of the inlet orifices of the coupling chamber;

means for striking the arc between the two coaxial electrodes;

means for cooling the electrodes, the gas injection devices and the coupling chamber;

coils creating around the first upstream electrode, a magnetic field ensuring the displacement of the base of the arc around the inner surface of said upstream electrode.

According to an original feature of the ionized gas generator according to the invention, the means for injecting the gas in vortices in each module consist in a chamber supplying pressurized gas associated with a gas injection ring constituted by a cylindrical metal piece pierced with orifices opening tangentially with respect to the inner wall of the ring and distributed uniformly on this wall in the injection space comprised between the upstream electrode and the downstream electrode.

This injection of vortical gas, combined with the use, for each of the unitary modules, of high interelectrode voltage of several thousands of volts, leads to obtaining elongated arcs which may extend from the end of the upstream electrode up to the end of the downstream electrode, this giving an original character to this association of a plurality of modules, over the known prior art. These new features make it possible, in particular, to eliminate the inhomogeneities of temperature and flow of the jet of ionized gas whilst operating at temperatures of the order of 5000° C. and with pressures close to 100 bars, this corresponding to reduced enthalpies pertaining to the mass, of the order of 100. These orders of size, never obtained heretofore in homogeneous flow, allow easy interpretation and reproducibility of the tests on samples. These interesting results are quite naturally combined with one of the important advantages of the plurimodular structure of the generator, namely the fact that the sample tested is protected from direct radiation of the arc.

In a preferred embodiment of the ionized gas generator forming the subject matter of the present invention, the unitary modules are four in number, and the coupling chamber is composed of a hollow central part in spherical form to which five cylindrical passages are connected in centred manner, namely four first passages located in the same plane at 90° with respect to one another, and into each of which the jet of ionized gas from one of the modules opens, and a fifth, perpendicular to the plane of the first four, and which bears the nozzle for emission of the jet of ionized gas of the generator.

The invention will be more readily understood on reading the following description with reference to the accompanying drawings, in which.

Figure 1:
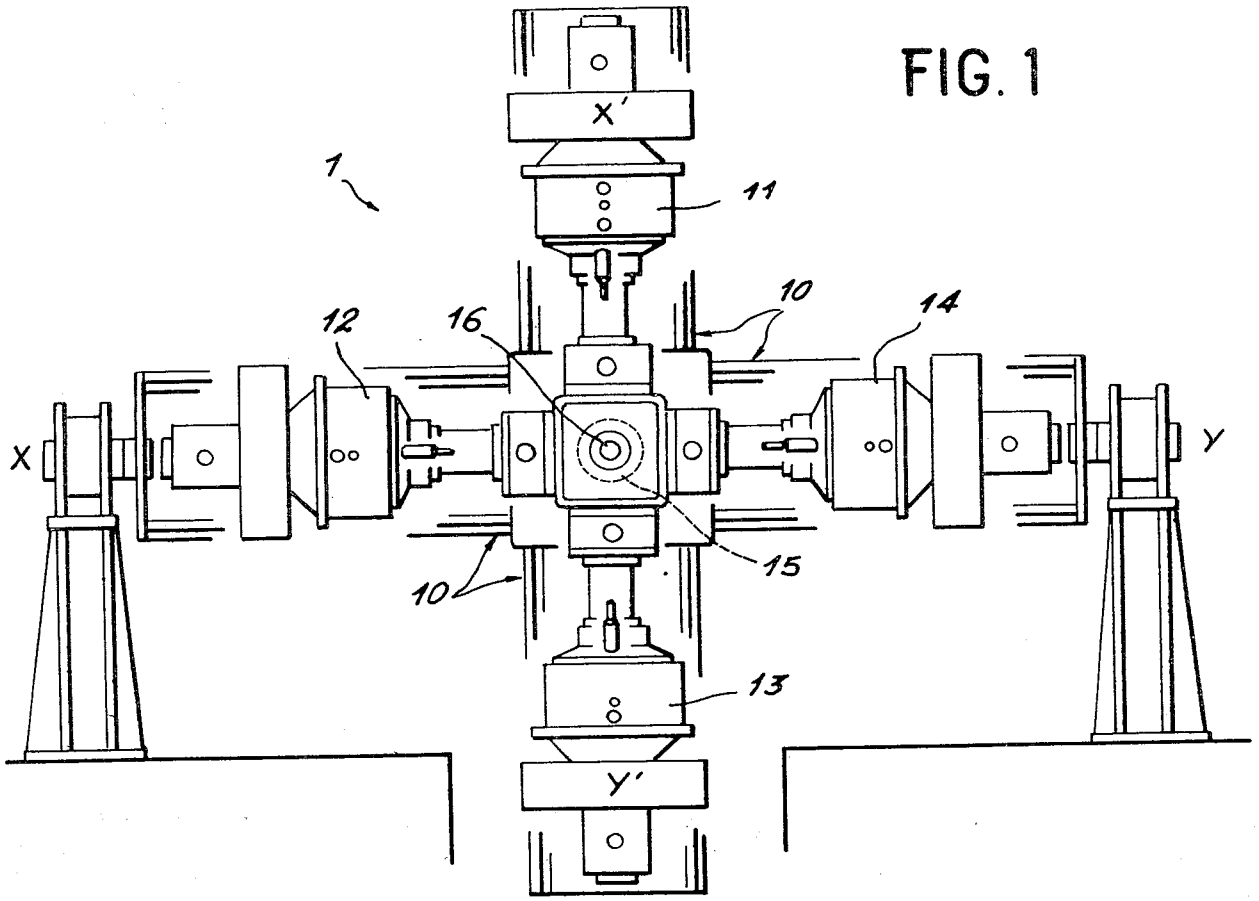
FIG. 1 shows a view in elevation of the ionized gas generator according to the invention.

Referring now to the drawings, FIG. 1 schematically shows the generator 1 constituted by a four-part support 10 in cruciform arrangement. The actual generator is constituted by four modules 11, 12, 13 and 14 all four located in the vertical plane containing the axes XY and X'Y'; the modules are aligned in two's, namely on the one one hand modules 11 and 13 which are vertical, and, on the other hand, modules 12 and 14 which are horizontal. These four modules 11, 12, 13 and 14 are associated with a coupling chamber 15 likewise located in the plane of FIG. 1, and from which emerges, perpendicularly to this same plane, a nozzle 16 bringing together the overall flow of ionized gas produced by the four modules of the generator. To this end, the gas heated and ionized by an electric arc produced in each module is collected at the coupling chamber 15, then expanded through the nozzle 16 so as to produce a supersonic, homogeneous flow at very high temperature and at high speed, said flow being perpendicular to the vertical plane of FIG. 1 which includes the axes of the four modules.

Figure 2:
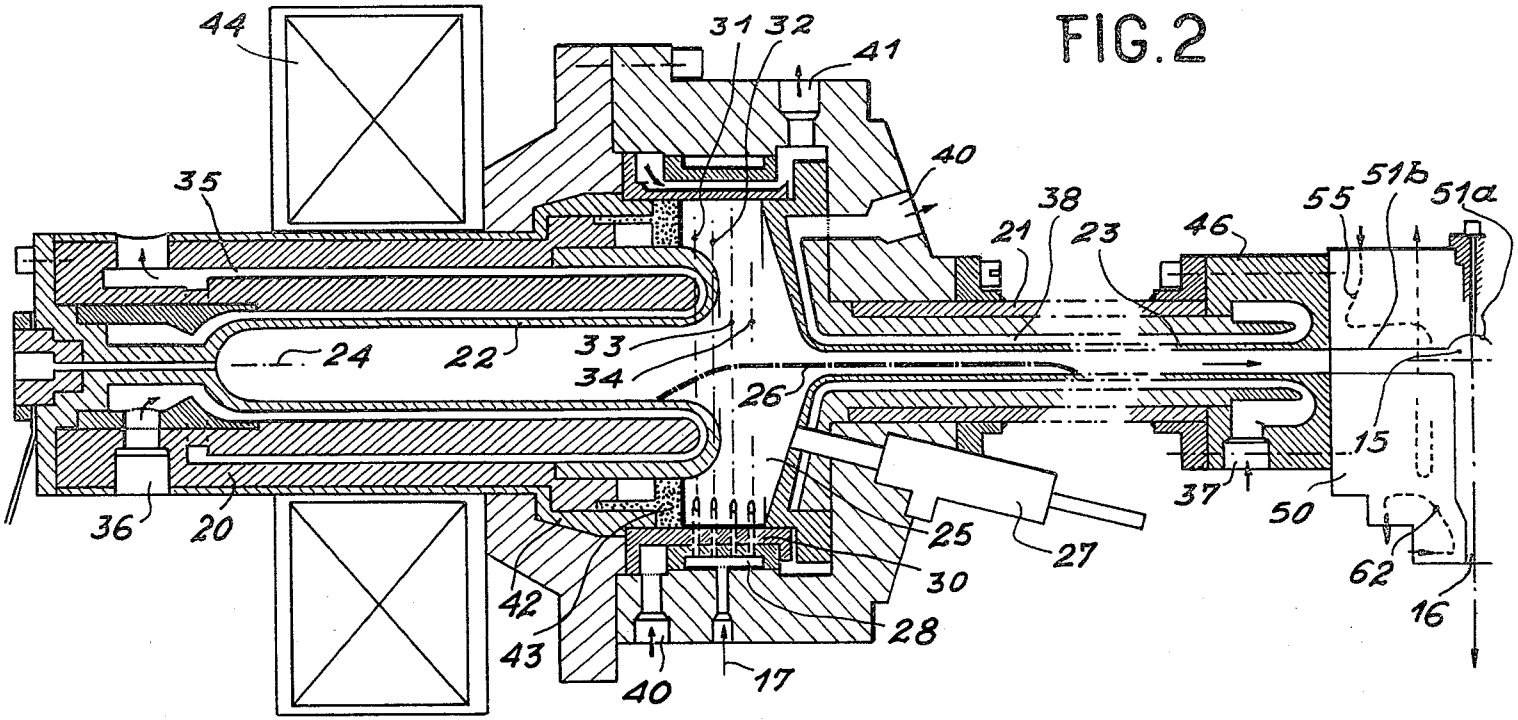
FIG. 2 shows one of the modules constituting the generator of FIG. 1, in section along axis XY.

Referring now to FIG. 2, the constitution of a unitary module will now be described in greater detail. FIG. 2 shows the envelope 20 of the upstream electrode 22 and the envelope 21 of the downstream electrode 23. According to the invention, these two electrodes are substantially cylindrical and disposed in line with each other along their common axis 24. Moreover, the electrode 23 is pierced right through, which enables the gas injected to flow from one end thereof to the other, as will be seen hereinafter. A chamber 25 separates the two upstream and downstream electrodes 22 and 23 respectively, into which chamber the supply gas of the generator is injected, as will be seen hereinafter. A D.C. electric arc 26 is struck in the space 25 between the end of the electrode 22 and the electrode 23 with the aid of an auxiliary starter electrode 27 which may be of any known type. Under the action of the air injected into the chamber 25 and which flows towards the outlet of the hollow cylindrical electrode 23, the electric arc also extends and takes a very elongated form characteristic of the generator forming the subject matter of the present invention.

The injection of gas into the chamber 25 is effected as follows. The gas is injected, by any known system, at 17 into a supply chamber 28, which communicates with a gas injection ring 30 constituted by a cylindrical metal piece pierced with orifices opening tangentially with respect to the inner wall of the ring and distributed uniformly on this wall in the injection space 25 comprised between the upstream electrode 22 and the downstream electrode 23. In the example shown in the Figure, the injection orifices of the ring are distributed in four planes 31, 32, 33 and 34, equidistant from one another and perpendicular to the common axis 24 of the apparatus.

According to the invention, a cooling circuit 35, supplied through the inlet 36, is located around the upstream electrode 22 between this electrode proper and its envelope 20. The cooling liquid circulating in these envelopes allows an energetic cooling of the electrodes whilst the apparatus is functioning. An identical structure also equips the downstream electrode 23 which is surrounded by a cooling circuit 38 supplied through the inlet 37 located in the electrode envelope 21. Similarly, the gas injection ring 30 is provided with its own water cooling circuit with inlet 40 and outlet 41 in FIG. 2 and constituted by a certain number of bores parallel to the common axis 24 of the generator and distributed over the circumference of the gas injection ring 30.

In the embodiment described in FIG. 2, the gas injection ring is, by construction, at the same potential as the downstream electrode 23. It was therefore necessary to provide a device for electric and thermal insulation of this injection ring 30 with respect to the upstream electrode 22. This double thermal and electric insulation is constituted by a nylon sleeve 42 which ensures electrical insulation and a silicon nitride ring 43 which ensures thermal insulation.

Moreover, to avoid rapid wear of the inner surface of the upstream electrode 22, it has been provided to displace the base of the arc 26 around the inner surface of this electrode 22 by means of a magnetic field produced with the aid of a set of slab coils or solenoids 44 coaxial with respect to the axis 24, mobile parallel to this axis and having a D.C. electric current passing therethrough.

The module of FIG. 2 is connected to the coupling chamber 15 by a connecting piece 46. The coupling chamber 15 itself is constituted by an outer envelope 50 made of copper or copper alloy, of cubic shape, in which is located a monobloc inner piece 51 also made of copper or copper alloy comprising a spherical part 51*a* and five cylindrical parts 51*b* connected to the spherical part 51*a*. The first four of these cylindrical parts 51*b* are in direct communication with the downstream electrodes 23 of each module and the fifth opens directly on the nozzle 16, as may be seen in FIG. 3. FIG. 2 also shows in dotted lines the path of the cooling circuit 55 of the inner piece 51 and of the cooling circuit 62 of the nozzle 16.

Figure 3:
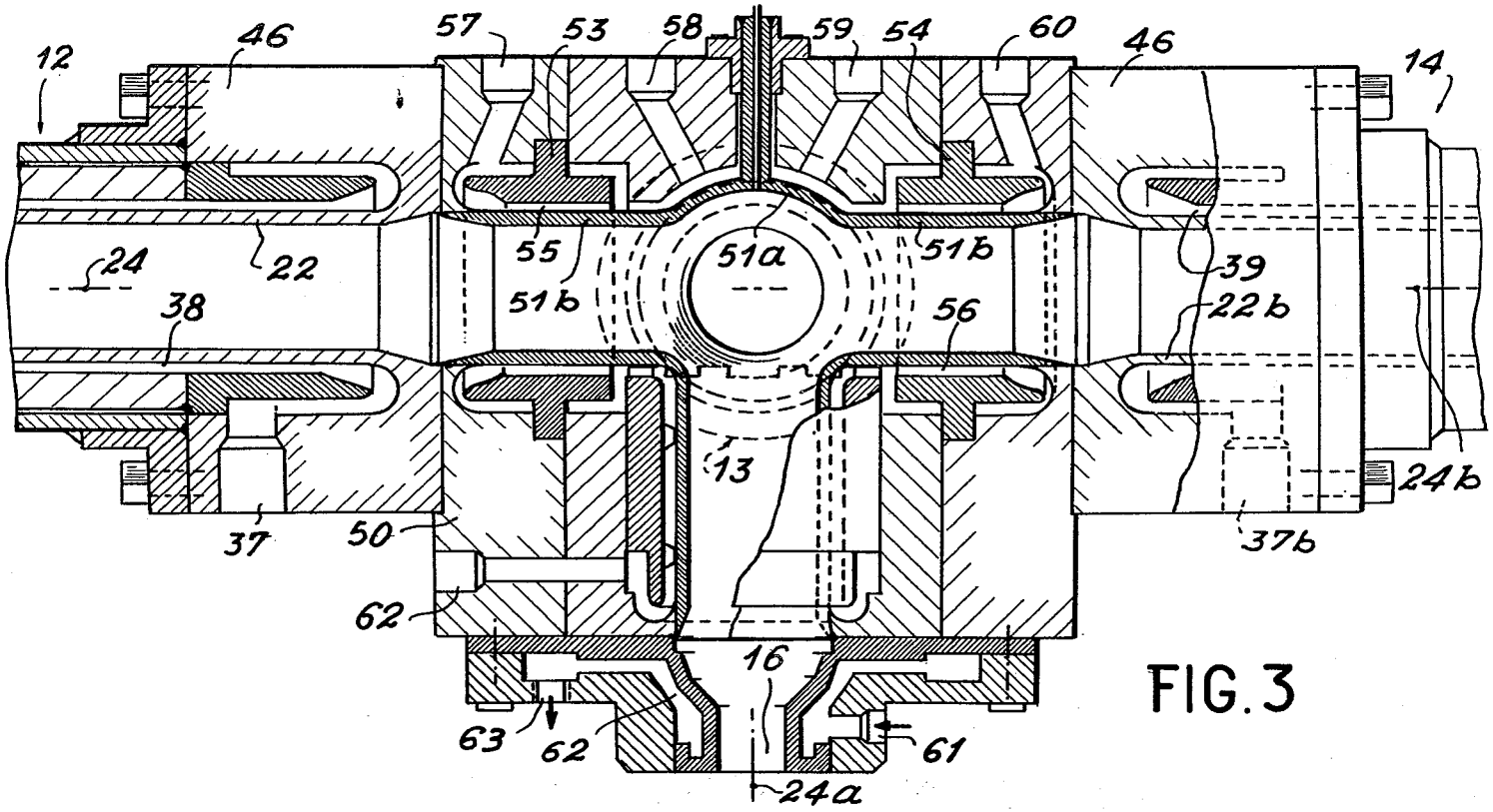
FIG. 3 shows in the horizontal plane XY of FIG. 1, the coupling chamber and the connections thereof with two of the diametrically opposite modules.

With reference to FIG. 3, the coupling chamber and its connections with the four unitary modules will now be described in greater detail. This Figure shows the connecting pieces 46 connecting the two modules 12 and 14 to the coupling chamber 15. In FIG. 3, the other two modules are not visible, module 11 being in front of the Figure and module 13 showing, at the end of the chamber 15, only the end of its structure shown in the form of concentric circles in dashed lines. The actual coupling chamber is constituted by an outer block 50 in cubic form and in which is hollowed a cavity coated with an inner piece 51 made of copper or copper alloy, monobloc, constituted by a spherical part 51*a* connected to five cylindrical parts 51*b*, of which only three are, of course, visible in FIG. 3, centred on the respective axes 24 and 24*b* of the modules 12 and 14 and on the axis 24*a* of nozzle 16. The internal arrangement of the block 50 is such that separators 53 and 54 define paths of water circulation by thin films such as 55 and 56 to cool the inner piece 51. Inlets for pressurised water such as 57,58,59 and 60 are provided for supplying this cooling circuit. An inlet for water under pressure, 61, is provided to supply the cooling circuit 62 of the nozzle 16, the corresponding outlet being referenced 63. FIG. 3 also shows the electrode 22 of the module 12 as well as the electrode 22*b* of the module 14 also provided with their respective cooling circuits 38 and 39.

The generator which has just been described functions as follows: the different cooling circuits such as 38,39,41,57,58,59 and 60 are initially supplied from a system of pumps and valves allowing the individual control of pressures and rates of flow of these circuits, at values such that the differences between these pressures and atmospheric pressure prevailing initially in the generator are small. In the course of the following phase, voltage is applied to the coils 44 producing the magnetic field. A short-circuit is then produced between the upstream electrode 22 and the end of the central rod of the starter electrode 27. The gas is then injected into the generator through the orifices located in planes 31,32, 33 and 34 as far as the module shown in FIG. 2 is concerned; the current of the electric arc is then established, whilst eliminating the short circuit between the upstream electrode 22 and the end of the central rod of the starter electrode. When the central rod of the starter electrode has terminated its displacement corresponding to the elimination of the short-circuit, the arc 26 of each module is transferred between the two electrodes 22 and 23 and extends under the effect of the injection of vortical gas. Stable and reliable functioning is then obtained, resulting from the constancy of the parameters; are current, rate of flow of gas and control of the pressures in the cooling circuits by the pressure prevailing in the generator, thus minimising the mechanical and thermal stresses on the electrodes 22 and 23, the gas injection chamber 30, the inner piece 51 of the coupling chamber 15 and the inner part of the nozzle.

By way of example, and for one embodiment, the dimensioning and performances of the electrical supply means producing the electric arcs, the water supply means for the cooling circuits, the gas supply means for the generator, and of the generator itself are as follows:

Electrical supply means: four supplies each able to deliver 1500 A under 7000 V, or 3000 A under 3500 V.

Water supply means: three supply pumps each able to deliver 40 l/s under 100 bars, associated with distributing circuits using controlled valves.

Gas supply means: storage reservoirs under 420 bars of pressure able to deliver 0.5 kg/s of gas to be ionized per module at a maximum pressure of 250 bars.

Generator: obtaining of conditions generating the jet of ionized gas, i.e. of pressures of the order of 100 bars and reduced enthalpies pertaining to the mass, of the order of 100.

What is claimed is:

1. An ionized gas generator for supplying a supersonic homogeneous ionized gas flow comprising a plurality of unitary ionized gas generator modules connected to a coupling chamber having a nozzle for supplying a jet of ionized gas, each of the unitary gas generator modules comprising an upstream and a downstream hollow elongated substantially cylindrical electrode of copper or copper alloy, the electrodes being coaxial and spaced apart by an intermediate chamber to which an open first end of each electrode is connected, the upstream electrode having an opposite second end that is closed and the downstream electrode having an opposite second end that is open and in communication with the coupling chamber; means for supplying a high voltage of at least several thousands of volts to the electrodes; means for striking an arc between the electrodes; means for injecting a vortical gas along a plurality of planes perpendicular to the axis of the electrodes in the intermediate chamber therebetween, the injected gas passing through the electric arc and the center of the downstream electrode and causing the electric arc to take an elongated shape such that the arc has a length several times greater than the spacing between the electrodes and is capable of extending from the upstream electrode to the region of the second end of the downstream electrode; moveable magnetic field means for generating around the upstream electrode a magnetic field to cause displacement of a base of the electric arc about the interior surface of the upstream electrode; and means for cooling the electrodes, the gas injecting means, and the coupling chamber.

2. The ionized gas generator of claim 1, wherein the means for injecting the vortical gas in each module comprises a gas injection ring and an associated supply chamber for pressurized gas, the injection ring being constituted by a cylindrical metal piece disposed within the intermediate chamber and pierced with orifices opening tangentially with respect to an inner wall of the ring and into the intermediate chamber, the orifices being formed to provide a sonic flow of gas and being distributed uniformly about such wall in the plurality of planes.

3. The ionized gas generator of claim 1, wherein the unitary modules are four in number, the coupling chamber is composed of a hollow central part, spherical in form, to which five cylindrical passages are connected in centered manner, four passages being located in the same plane at 90° with respect to one another and into each of which a jet of ionized gas from one of the modules flows, and a fifth passage being perpendicular to the plane of the first four and carrying the nozzle for supplying the jet of ionized gas of the generator.

* * * * *